US010777872B1

(12) United States Patent
Glabe et al.

(10) Patent No.: US 10,777,872 B1
(45) Date of Patent: Sep. 15, 2020

(54) LOW PROFILE COMMUNICATIONS ANTENNAS

(71) Applicant: General Atomics, San Diego, CA (US)

(72) Inventors: John Robert Glabe, Ramona, CA (US); Daniel George Laramie, Oceanside, CA (US)

(73) Assignee: GENERAL ATOMICS, San Diego, CA (US)

( * ) Notice: Subject to any disclaimer, the term of this patent is extended or adjusted under 35 U.S.C. 154(b) by 320 days.

(21) Appl. No.: 15/642,247

(22) Filed: Jul. 5, 2017

(51) Int. Cl.
*H01Q 1/00* (2006.01)
*H01Q 1/12* (2006.01)
*H01Q 1/50* (2006.01)

(52) U.S. Cl.
CPC ..... *H01Q 1/12* (2013.01); *H01Q 1/50* (2013.01)

(58) Field of Classification Search
CPC ..... H01Q 1/12; H01Q 1/50
See application file for complete search history.

(56) References Cited

U.S. PATENT DOCUMENTS 4,924,236 A * 5/1990 Schuss ..... H01Q 9/0442 343/700 MS
5,952,971 A * 9/1999 Strickland ..... H01Q 1/38 343/700 MS
6,184,828 B1 * 2/2001 Shoki ..... H01Q 3/26 342/372
6,320,542 B1 * 11/2001 Yamamoto ..... H01Q 1/38 343/700 MS
2005/0206568 A1 * 9/2005 Phillips ..... H01Q 9/0414 343/700 MS
2006/0007044 A1 * 1/2006 Crouch ..... H01Q 9/0435 343/700 MS
2007/0210973 A1 * 9/2007 Tanaka ..... H01Q 1/273 343/720
2008/0036665 A1 * 2/2008 Schadler ..... H01Q 1/42 343/700 MS
2009/0128413 A1 * 5/2009 Crouch ..... H01Q 3/26 343/700 MS
2010/0194663 A1 * 8/2010 Rothwell ..... H01Q 9/0407 343/876
2011/0025574 A1 * 2/2011 Tiezzi ..... H01Q 3/26 343/824
2011/0199279 A1 * 8/2011 Shen ..... H01Q 9/0414 343/857
2012/0154235 A1 * 6/2012 Nakamura ..... H01Q 9/0428 343/787
2012/0182185 A1 * 7/2012 Parsche ..... H01Q 1/2225 343/700 MS
2013/0278467 A1 * 10/2013 Dassano ..... H01Q 9/0414 343/700 MS
2014/0097995 A1 * 4/2014 McKinzie, III ..... H01Q 9/0407 343/793

(Continued)

OTHER PUBLICATIONS

DM C196-1-1 UHF SATCOM Antenna Brochure, AIL Systems, Inc., available at http://www.ic72.com/pdf_file/d/122902.pdf.

*Primary Examiner* — Trinh V Dinh
(74) *Attorney, Agent, or Firm* — Perkins Coie LLP

(57) ABSTRACT

Systems and devices are disclosed for implementing a low profile antenna that can be mounted on various platforms or vehicles without significantly changing the appearance of the platform or vehicle. The disclosed technology can be used to construct low profile antennas to reduce the antenna thickness while maintaining high efficiency.

16 Claims, 8 Drawing Sheets

(56) References Cited

U.S. PATENT DOCUMENTS

| | | | | |
|---|---|---|---|---|
| 2015/0123868 | A1* | 5/2015 | Bit-Babik | H01Q 9/0464 343/857 |
| 2017/0093042 | A1* | 3/2017 | McMichael | H01Q 5/40 |
| 2017/0288299 | A1* | 10/2017 | Ikeda | H01Q 9/0421 |
| 2018/0269557 | A1* | 9/2018 | Fangfang | H01P 3/123 |

* cited by examiner

LOW PROFILE COMMUNICATIONS ANTENNAS

TECHNICAL FIELD

This patent document relates to antennas for communications including antennas used in satellite communications.

BACKGROUND

An antenna is used as a radio transmitter to send out information via a radio wave that carries the intended information to be sent out or a radio receiver that receives an incoming radio wave to extract information. In transmission, a radio transmitter supplies an electric current oscillating at a radio frequency (e.g., a high frequency alternating current (AC)) to the antenna's terminals, and the antenna radiates the energy from the current as electromagnetic waves (radio waves). In reception, an antenna intercepts some of the power of an electromagnetic wave to produce a voltage or current at its terminals that is processed in a receiver.

SUMMARY

This patent document discloses low profile antennas that can be mounted on various platforms or vehicles without significantly changing the appearance of the platform or vehicle. In some implementations, this disclosed technology can be used to construct low profile antennas to reduce the antenna thickness while maintaining a high efficiency. The disclosed low profile antennas can be used in various applications, including UHF Satellite communications systems or the MUOS (Mobile User Objective System) Systems. The specific examples disclosed below include low profile antennas with a circular polarization, a desired high efficiency, a desired antenna gain, and can be configured to have an impedance match that satisfies the return loss requirements of the UHF and MUOS radios. Such low profile antennas can be inexpensive to build due to reduced number of parts and its low profile makes it suitable for applications such as mounting on vehicle rooftops or situations where a concealed antenna is desired.

In an exemplary embodiment, an antenna is disclosed. The antenna includes a top metal circular plate to radiate or receive electromagnetic waves; a dielectric spacer formed of a first dielectric material and located below the top metal circular plate, the dielectric spacer comprising openings extending vertically through the dielectric spacer; a base plate located below the dielectric spacer, the base plate including multiple coaxial connectors; a plurality of conductive posts, wherein each conductive post is located in each opening in the dielectric spacer, and each conductive post comprises a top portion and a bottom portion, wherein the top portion of each conductive post is in contact with the top metal circular plate, and the bottom portion of each conductive post is electrically coupled to a center conductor of a corresponding coaxial connector; and a feed network connected to each coaxial connector, wherein the feed network is configured to produce a circularly polarized radiated field.

In some embodiments, the top metal circular plate includes holes located along a perimeter of a first circle, wherein each hole allows the top portion of each conductive post to be in contact with the top metal circular plate; and the base plate comprises orifices located along a perimeter of a second circle, wherein each orifice includes a coaxial connector. The some embodiments, a first diameter of the first circle including the holes is the same as a second diameter of the second circle including the orifices, wherein each hole in the top metal circular plate is coincident with a corresponding orifice in the base plate. In some embodiments, the top metal circular plate includes four holes located along the perimeter of the first circle with an angular spacing of 90° between each of four angles formed by the location of the four holes. In some embodiments, the location of the four holes forms a square shape. In an embodiment, the base plate includes four orifices. In some embodiments, the conductive posts include four conductive posts. In an embodiment, the top portion of each conductive post includes a first indentation to receive a screw to secure the top metal circular plate to the top portion of the conductive post. In an embodiment, the bottom portion of each conductive post includes a second indentation to receive the center conductor of the coaxial connector.

In some embodiments, the dielectric spacer is circular. In an embodiment, the dielectric spacer has a diameter that is equal to a diameter of the top metal circular plate.

In some embodiments, each of the indentations and each of the blocks has a trapezoid shape. In an embodiment, each of the trapezoid shaped indentations includes a curved base located along an outer circumference of the dielectric spacer.

In some embodiments, the antenna further includes a metal post located on top of the base plate with a center of the metal post coinciding with a center of the top metal circular plate.

In some embodiments, the coaxial connector is mechanically coupled to a bottom side of the base plate using at least one of soldering, threaded fittings, or set screw. In some embodiments, locations of the coaxial connectors form a quadrilateral with an axis of symmetry that is rotated 90 degrees relative to an axis of symmetry of the base plate.

In some embodiments, the antenna further comprises a plurality of radially distributed indentations located on a bottom surface of the dielectric spacer; and a plurality of blocks located below the dielectric spacer and the plurality of blocks, wherein each block is located in each indentation of the dielectric spacer and is formed of a second dielectric material having a dielectric constant higher than a dielectric constant of the first dielectric material.

In another exemplary embodiment, an antenna comprises a top metal circular plate to radiate or receive electromagnetic waves; a rectangular dielectric spacer located below the top metal circular plate, the rectangular dielectric spacer comprising openings extending vertically through the dielectric spacer; a rectangular base plate located below the rectangular dielectric spacer, the rectangular base plate including multiple coaxial connectors; a plurality of conductive posts, wherein each conductive post is located in each opening in the rectangular dielectric spacer, and each conductive post comprises a top portion and a bottom portion, wherein the top portion of each conductive post is in contact with the top metal circular plate, and the bottom portion of each conductive post is electrically coupled to a center conductor of a corresponding coaxial connector; and a feed network connected to each coaxial connector, wherein the feed network is configured to produce a circularly polarized radiated field.

In some embodiments, the top metal circular plate includes holes located along a perimeter of a first circle, wherein each hole allows the top portion of each conductive post to be in contact with the top metal circular plate; and the base plate comprises orifices located along a perimeter of a second circle, wherein each orifice includes a coaxial connector. In some embodiments, a first diameter of the first circle including the holes is the same as a second diameter of the second circle including the orifices, wherein each hole in the top metal circular plate is coincident with a corresponding orifice in the base plate. In some embodiments, the top metal circular plate includes four holes located along the perimeter of the first circle with an angular spacing of 90° between each of four angles formed by the location of the four holes. In some embodiments, the location of the four holes forms a square shape. In some embodiments, the base plate includes four orifices. In some embodiments, the conductive posts include four conductive posts. In some embodiments, the top portion of each conductive post includes a first indentation to receive a screw to secure the top metal circular plate to the top portion of the conductive post. In some embodiments, the bottom portion of each conductive post includes a second indentation to receive the center conductor of the coaxial connector.

In some embodiments, the coaxial connector is mechanically coupled to the rectangular base plate using at least one of soldering, threaded fittings, or set screw. In some embodiments, locations of the coaxial connectors form a quadrilateral with an axis of symmetry that is rotated 90 degrees relative to an axis of symmetry of the rectangular base plate.

In another exemplary embodiment, an antenna, comprises a top metal plate to radiate or receive electromagnetic waves; a base plate located below the top metal plate, the base plate including multiple coaxial connectors; a cavity in between the top metal plate and the base plate; a plurality of conductive posts, wherein each conductive comprising a top portion and a bottom portion, wherein the top portion of each conductive post is in contact with the top metal plate, and the bottom portion of each conductive post is electrically coupled to a center conductor of a corresponding coaxial connector; and a feed network connected to each coaxial connector, wherein the feed network is configured to produce a circularly polarized radiated field.

In some embodiments, a shape of a top surface of the top metal plate includes a flat surface, a single curved surface, or a doubly curved surface. In some embodiments, the cavity includes a square shape, a diamond shape, or a circular shape.

In some embodiments, the top metal plate includes holes located along a perimeter of a first circle, wherein each hole allows the top portion of each conductive post to be in contact with the top metal plate; and the base plate comprises orifices located along a perimeter of a second circle, wherein each orifice includes a coaxial connector.

In some embodiments, a first diameter of the first circle including the holes is the same as a second diameter of the second circle including the orifices, wherein each hole in the top metal plate is coincident with a corresponding orifice in the base plate. In some embodiments, the top metal plate includes four holes located along the perimeter of the first circle with an angular spacing of 90° between each of four angles formed by the location of the four holes. In some embodiments, the location of the four holes forms a square shape. In some embodiments, the base plate includes four orifices. In some embodiments, the conductive posts include four conductive posts. In some embodiments, the top portion of each conductive post includes a first indentation to receive a screw to secure the top metal plate to the top portion of the conductive post. In some embodiments, the bottom portion of each conductive post includes a second indentation to receive the center conductor of the coaxial connector.

In some embodiments, the coaxial connector is mechanically coupled to a bottom side of the base plate using at least one of soldering, threaded fittings, or set screw. In some embodiments, locations of the coaxial connectors form a quadrilateral with an axis of symmetry that is rotated 90 degrees relative to an axis of symmetry of the base plate.

The above and other aspects and their implementations and examples are described in greater detail in the drawings, the description and the claims.

DETAILED DESCRIPTION

A low profile antenna for UHF SATCOM and/or MUOS satellite communications systems or other applications can be shaped in a generally circular geometry. Various circularly polarized antennas for this frequency band tend to be thicker than 4 inches, or have lower radiated performance. For certain applications, a four inch thick antenna protrudes over a surface of a platform or a vehicle is noticeable and prominent and thus can be undesirable. Thinner antennas with low profiles are desirable in various applications. However, low profile antennas formed of conductive materials tend to have low antenna radiation efficiency. For example, some designs of circular antennas with a thickness close to 1 inch are shown to exhibit unacceptable low radiation efficiency. The disclosed technology in this patent document can be used to construct a low profile circular antenna of a thickness of about 1 inch thick with a high radiation efficiency, e.g., in the frequency bands for UHF SATCOM and/or MUOS satellite communications. In some implementations, such a low profile antenna can be based on a radial waveguide with a circular radiation aperture.

Figure 1:
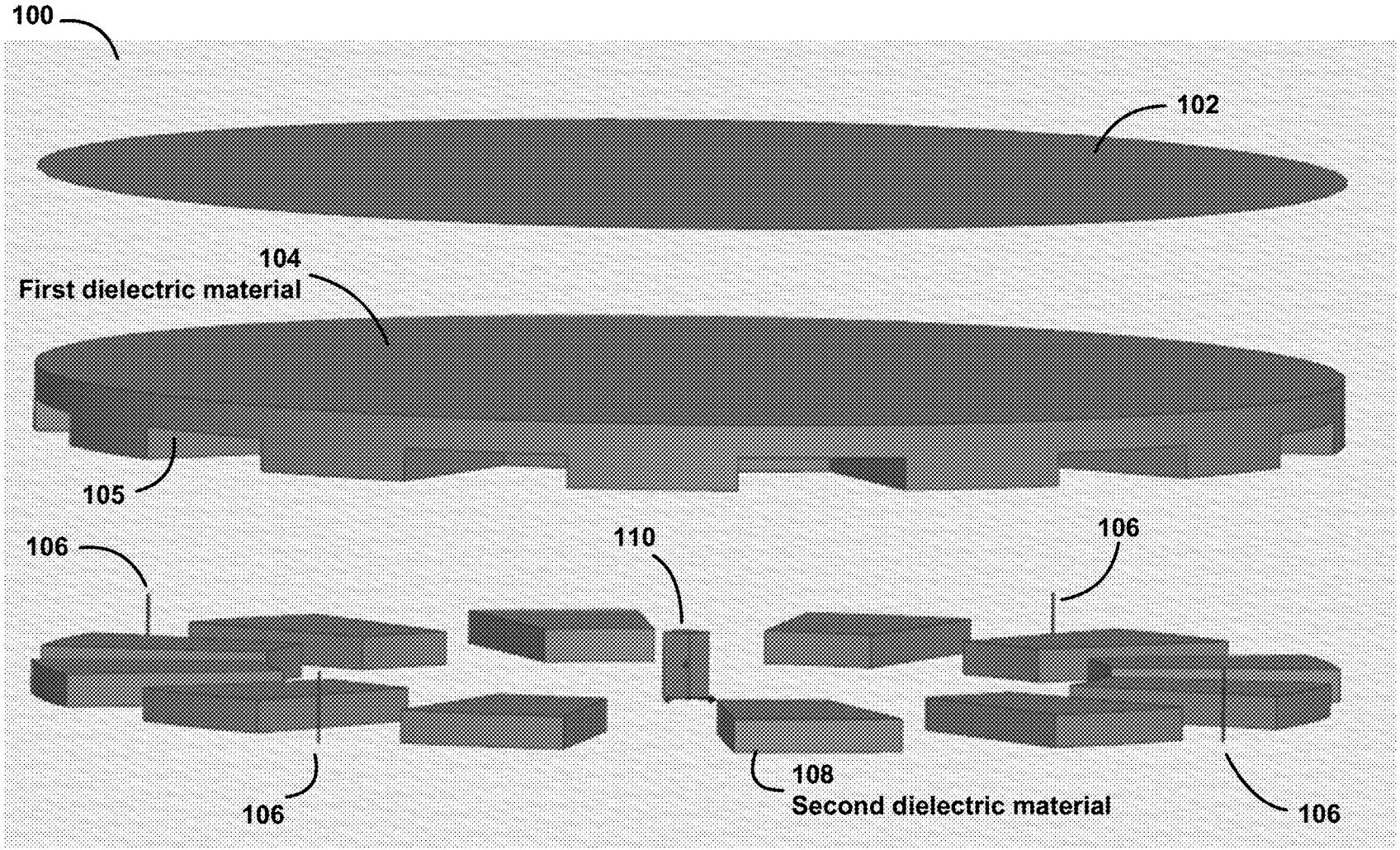
FIG. 1 shows an exploded view of a first exemplary low profile SATCOM/MUOS antenna.

FIG. 1 shows a first exemplary embodiment of a low profile antenna (100) in a circular geometry. The antenna (100) includes a circular radiating plate (102) which radiates the outgoing electromagnetic wave in transmission and also receives an incoming electromagnetic wave in a reception operation. The circular radiating plate (102) is formed of an electrical conductor material, such as metal. Below the circular radiating plate (102) is a middle dielectric spacer (104) in a circular geometry with a dimension identical or similar to that of the top circular radiating plate (102). In the illustrated example, the middle dielectric spacer (104) can include a smooth top surface that interfaces with the bottom of the circular radiating plate (102). In some embodiments, the middle dielectric spacer (104) can include a bottom surface with indentations (105). The antenna (100) includes conductive posts (106) that connect the top circular plate (102) to the antenna transceiver circuit to send out outgoing antenna signals and to direct received antenna signals to the antenna transceiver circuit. In some embodiments, the antenna (100) can also include a plurality of dielectric material blocks (108). The plurality of dielectric material blocks (108) can be inserted in the indentations (105) on the bottom surface of the middle dielectric spacer (104). In some embodiments, the middle dielectric spacer (104) can rest on top of the base plate/ground plane. In some embodiments, the middle dielectric spacer (104) with the plurality of dielectric material blocks (108) can rest on top of the base plate/ground plane. The antenna (100) can also include coaxial connectors that are mounted on the base plate/ground plane. The antenna (100) also includes a quadrature feed network as part of the antenna transceiver circuit. The quadrature fed network is electrically connected to the coaxial connectors. In some embodiments, the antenna (100) can also include a metal post (110) to provide additional mechanical strength to the antenna.

Figure 2A:
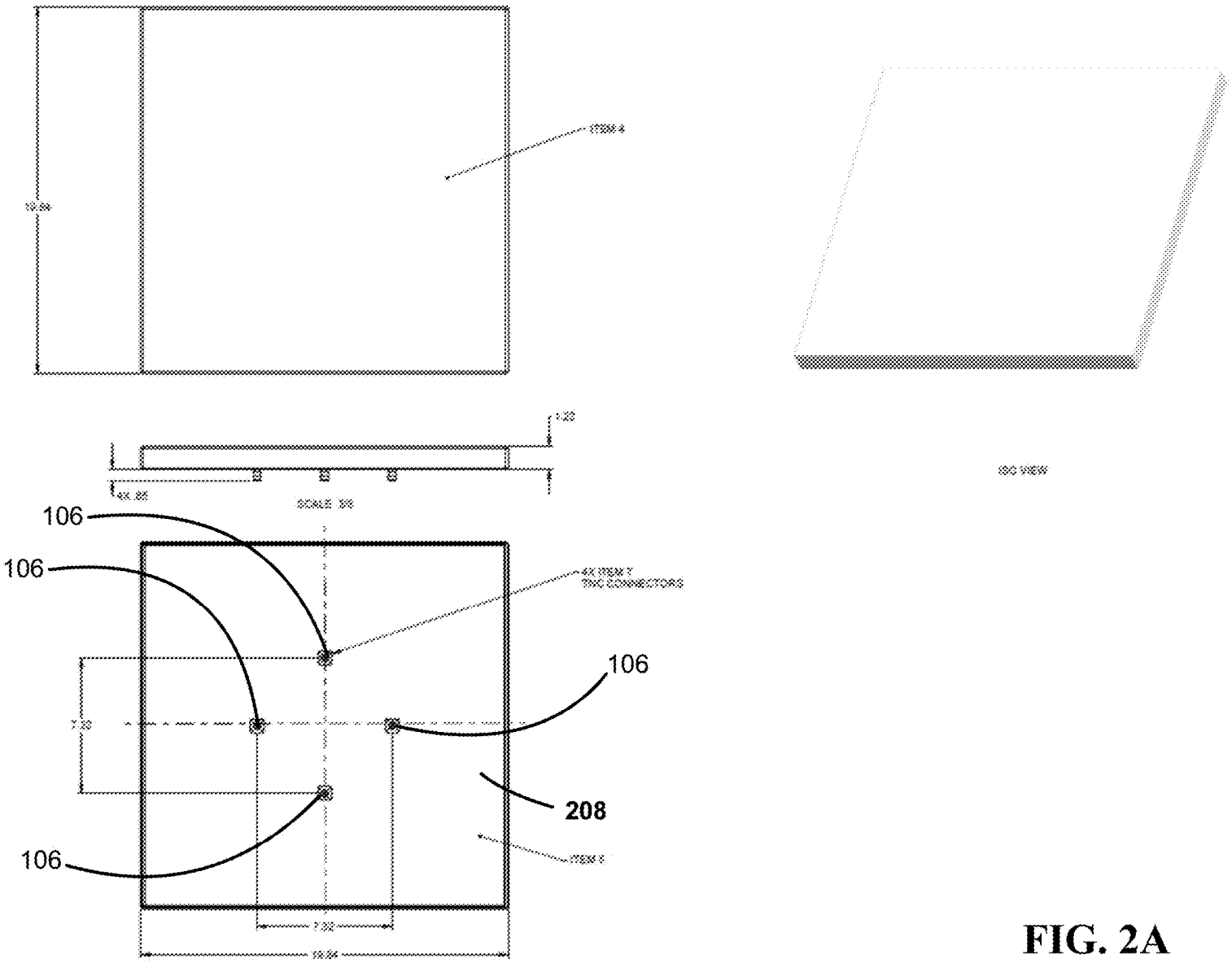
FIG. 2A shows several views of a first exemplary assembled SATCOM/MUOS antenna.
Figure 2B:
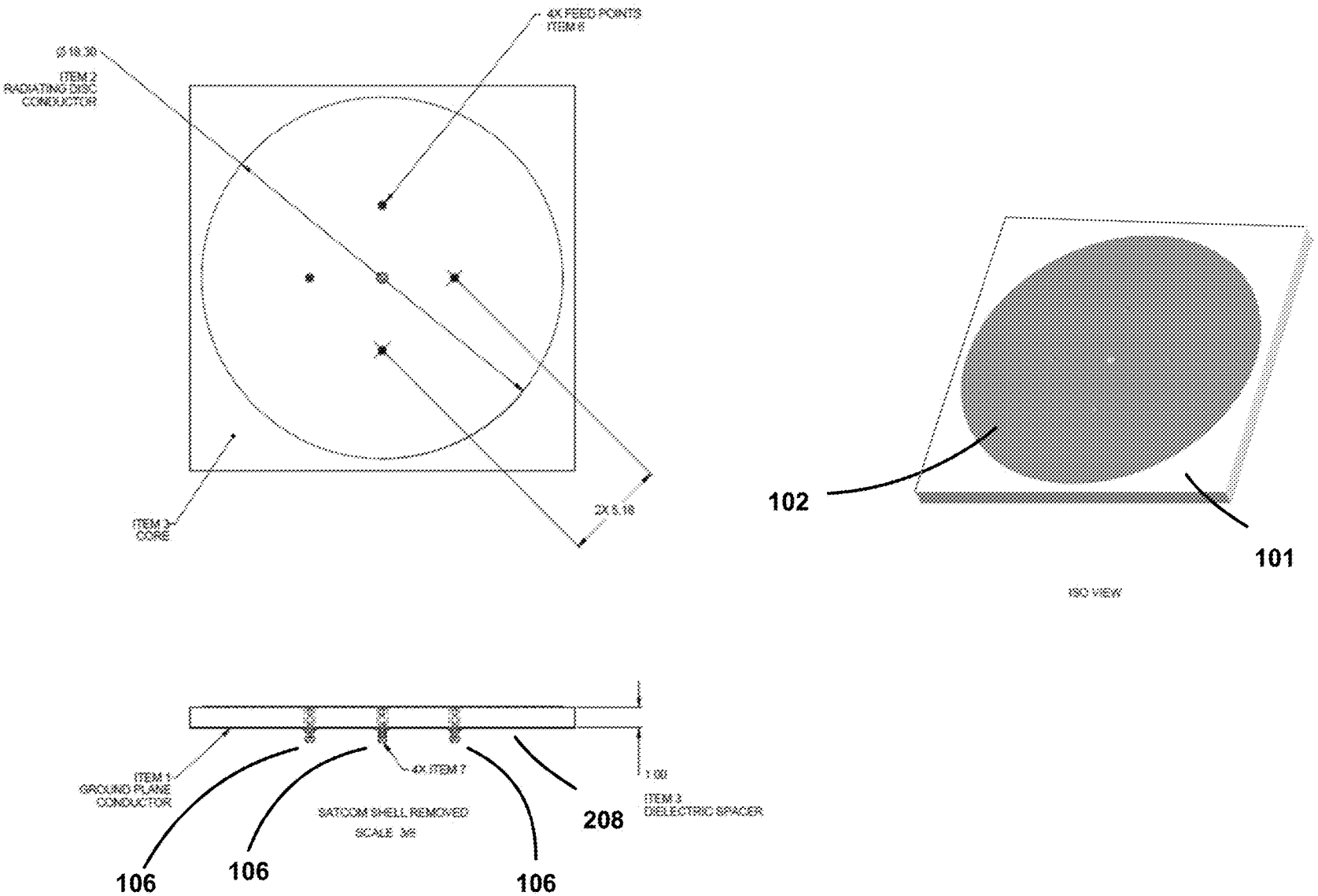
FIG. 2B shows several views of a first exemplary SATCOM/MUOS antenna with the SATCOM shell removed.

FIG. 2B shows different views of the low profile circular antenna (100) in FIG. 1. A top plate assembly (101) includes the circular radiating plate (102). In an exemplary aspect, the top plate assembly (101) and the circular radiating plate (102) can be the same part. Time varying currents can radiate energy into free space or receive energy from electromagnetic waves propagating in free space. The circular radiating plate (102) can be structured to have a diameter that allows the low profile antenna to transmit and receive data in a frequency range of 300 MHz to 3 GHz. In some exemplary aspects, the circular radiating plate (102) can have a diameter of 18.3 inches or 20 inches. The top plate assembly (101) can include four holes located on the perimeter of a first circle with an angular spacing of 90° between the four angles formed by the location of the four holes. The diameter of the first circle upon which the holes are located will generally be less than or equal to the diameter of the circular radiating plate (102). Further, the length between the centers of any two adjacent holes can be equal so that the four holes form a square shape. Four screws can be used to mechanically couple the top plate assembly (101) to the four conductive posts (106) via the four holes.

FIG. 1 also shows the features of the middle dielectric spacer (104). The middle dielectric spacer (104) includes a low dielectric constant material that allows the dielectric spacer to have a low electric field loss. In some embodiments, the dielectric spacer (104) can have a dielectric constant between 1 and 1.5, inclusive. One of the benefits of having a middle dielectric spacer (104) with a dielectric constant between 1 and 1.5, inclusive, is that it can facilitate a size reduction of the antenna. In some embodiments, the middle dielectric spacer (104) can have a higher dielectric constant material to allow for a more narrow banded antenna.

In some embodiments, a low dielectric constant low density material may be used for the middle dielectric spacer (104). In some embodiments, a middle dielectric spacer (104) can be made of a closed cell syntactic foam comprised of an epoxy or other dielectric resin filled with glass microballoons. In some embodiments, a middle dielectric spacer (104) can be made of structural foam, such as Rohacell® or syntactic foams, to provide mechanical ruggedness. In some embodiments, the middle dielectric spacer (104) can be a rigid closed cell foam that can add mechanical integrity to an assembled antenna. For example, the middle dielectric spacer (104) can be a 1 inch×20 inch circular disk from Rohacell®.

The middle dielectric spacer (104) can have four holes corresponding to the four holes on the top plate assembly (101). The holes in the middle dielectric spacer (104) extend vertically through the middle dielectric spacer (104). The holes in the middle dielectric spacer (104) can accommodate the conductive posts (106). In one exemplary aspect, each conductive post (106) can be fastened to each hole in the dielectric spacer (104) with an adhesive.

In some embodiments, the bottom surface of the middle dielectric spacer (104) can also have a plurality of indentations (105) that are radially located. The indentations (105) can have a trapezoid shape. Each indentations (105) can mate or interface with each of a plurality of blocks (108). The dielectric material blocks (108) have a similar shape as the indentations (105). The dielectric material blocks (108) can also have a trapezoid shape. The bottom surface of the middle dielectric spacer (104) and the dielectric material blocks (108) are located on top of the base plate/ground plane. In some embodiments, the dielectric constant of each block (108) can be less than 10. In some embodiments, the dielectric constant of each block can be approximately 3. In some embodiments, the low profile antenna can have twelve blocks and twelve corresponding indentations in the middle dielectric spacer (104). Further, the trapezoid shaped indentations (105) can be radially located along the outer circumference of the bottom surface of the middle dielectric spacer (104). The base of the trapezoid shaped indentation (105) can be curved. In some embodiments, the dielectric material blocks (108) can be made from a low loss dielectric solid material. For example, the dielectric material blocks (108) can be made from acrylic plastic, Teflon, delrin, G10 fiberglass or other materials.

The dielectric material blocks (108) may have a higher dielectric constant material than the middle dielectric spacer (104). One benefit of a higher dielectric constant material for the dielectric material blocks (108) is to reduce the overall size of the antenna. An electromagnetic wave propagating in a material with a dielectric constant greater than 1 will have a shorter wavelength than it has when propagating in air. The shortening of the wavelength is proportional to the dielectric constant. As a result, the higher dielectric constant material for the dielectric material blocks (108) further facilitates the overall reduction in size of the antenna.

FIGS. 2A-2B further illustrate the connection between the conductive posts (106) and the base plate/ground plane (208). The base plate/ground plane (208) can generally be the structural foundation of the exemplary low profile antenna. For example, the base plate (208) can also generally be the fundamental supporting structure for the antenna assembly and can provide the mechanical means of mounting the antenna to various vehicles or platforms. The base plate/ground plane (208) can include four holes that can be located along a perimeter of a second circle. In an exemplary aspect, the four holes of the base plate/ground plane (208) can correspond to and can be coincident with the four holes on the top plate assembly (101). The holes in the base plate/ground plane (208) can be located on the perimeter of a second circle with an angular spacing of 90° between the four angles formed by the location of the holes. Each hole in the base plate/ground plane (208) includes a coaxial connector. The diameter of the second circle upon which the holes are located will generally be less than or equal to the diameter of the circular radiating plate (102). Further, the length between the centers of any two adjacent holes can be equal so that the four connectors form a square shape. In one exemplary aspect, the locations of the four holes including the coaxial connectors form a quadrilateral with a horizontal and vertical axis of symmetry that are rotated 90 degrees relative to a vertical and horizontal axis of symmetry, respectively, of the base plate/ground plane (208).

In an exemplary embodiment, the conductive post includes a top end that can be drilled and tapped to create an indentation to receive a screw to secure the top plate assembly (101) to the top end of the conductive post. The lower end of the conductive post can also generally be drilled to create an indentation to receive the upper end of the coaxial connector's center conductor that may be fastened by soldering or use of a mechanical fastener. The conductive post serves to extend the center conductor of the connector can make electrical contact with the top plate assembly (101). In one aspect, the bottom of the conductive post makes electrical contact with the center conductor of the coaxial connector. The four coaxial connectors or their functional equivalents can be connected by their outer shells to the base plate/ground plane (208) by using, for example one or more of, soldering or mechanical fasteners such as threaded fittings or set screw. The outer shell of a coaxial connector can be conductive metal and can make an electrical connection to the base plate. The base plate and the outer shell of each coaxial connector can be at ground potential and can provide the ground reference for the assembly.

A feed network that produces a 90° phase progression will be connected to the four coaxial connectors to produce a circularly polarized radiated field. This feed network can consist of two 90° fed by the 0° and 180° outputs of a 180° or could consist of two 180° hybrids feed by the 0° and 90° outputs of a 90° hybrids. Such a feed network could also be integrated into a single assembly. Other feeding schemes can also be implemented. In another exemplary aspect, all four connectors could be fed in phase. This would produce a monopole type pattern and polarization. In yet another exemplary aspect, the opposite connectors could be fed out of phase to produce orthogonal linear polarizations.

In FIG. 1, the metal post (110) is located on top of the base plate/ground plane and it is located in the center of the low profile antenna. In an exemplary aspect, the metal post (110) can have a height of 0.5 inch with a diameter of 0.5 inch. One benefit of the metal post (110) is that it can provide additional mechanical strength to the antenna.

Figure 3:
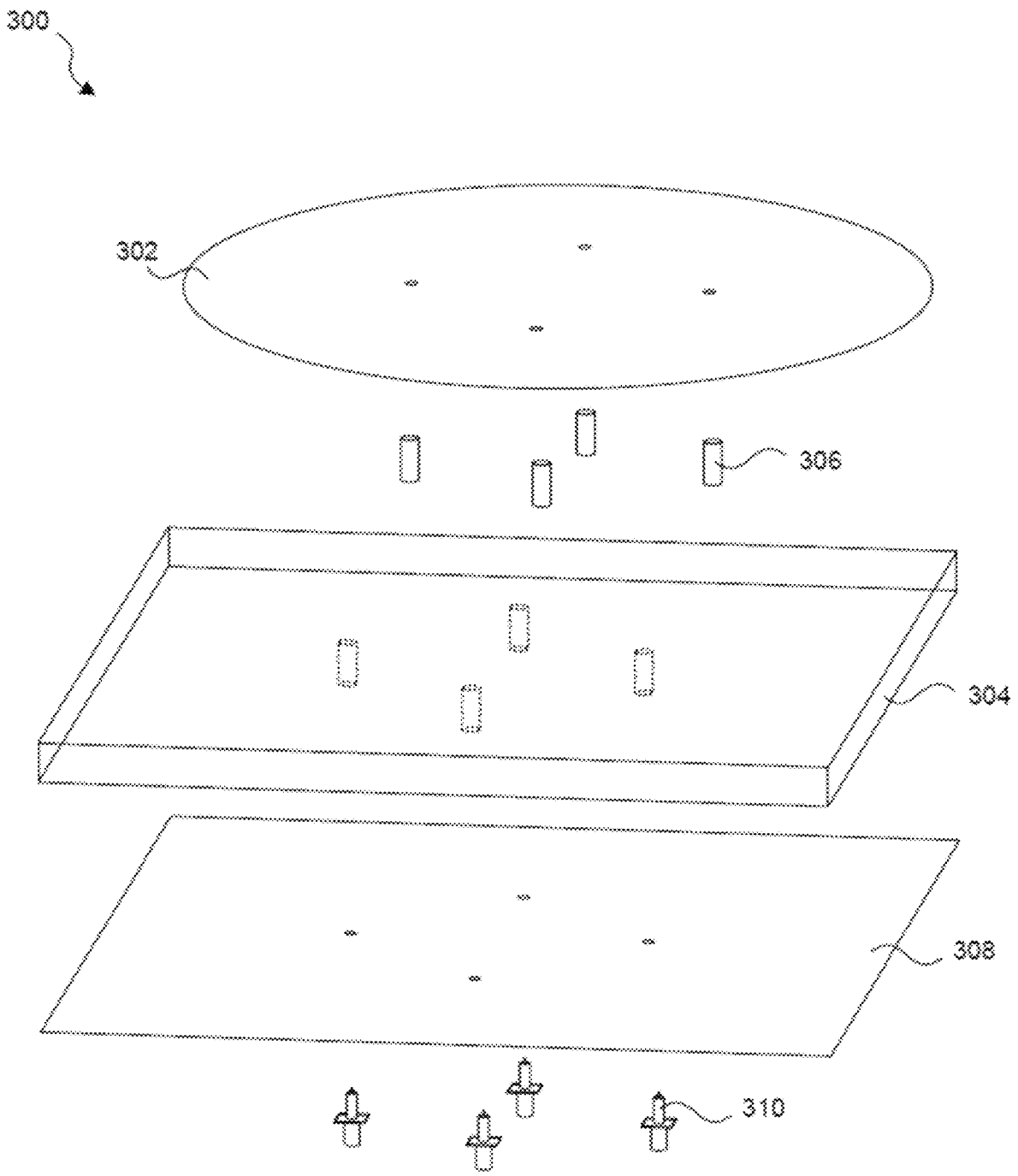
FIG. 3 shows an exploded view of a second exemplary low profile SATCOM/MUOS antenna.

FIG. 3 shows a second exemplary embodiment of a low profile antenna (300). The antenna (300) includes a top plate/radiating aperture assembly that radiates the outgoing electromagnetic wave in transmission and also receives an incoming electromagnetic wave in a reception operation. The top plate/radiating aperture assembly includes a radiating plate (302) that is formed of an electrical conductor material, such as metal. Below the top plate/radiating aperture assembly is a dielectric spacer (304) formed in a rectangular geometry with a dimension identical or similar to that of the top plate/radiating aperture assembly. In the illustrated example, the dielectric spacer (304) includes a smooth top surface that interfaces with the bottom of the top plate/radiating aperture assembly and a bottom surface. The antenna (300) includes conductive posts (306) that connect the top plate/radiating aperture assembly to the antenna transceiver circuit to send out outgoing antenna signals and to direct received antenna signals to the antenna transceiver circuit. The bottom surface of the dielectric spacer (304) rests on top of the base plate/ground plane (308). Furthermore, the antenna (300) includes coaxial connectors (310) that are mounted on the base plate/ground plane (308). The antenna (300) also includes a quadrature feed network as part of the antenna transceiver circuit. The quadrature fed network is electrically connected to the coaxial connectors (310).

The exemplary low profile antenna (300) includes a top plate assembly with a radiating plate (302). The radiating plate (302) can be circular with a diameter that allows the low profile antenna to transmit and receive data in a frequency range of 300 MHz to 3 GHz. In some exemplary aspects, the radiating plate (302) can have a diameter of 18.3 inches or 20 inches. The top plate/radiating aperture assembly can have with four holes located on the perimeter of a first circle with an angular spacing of 90° between the four angles formed by the location of the four holes. The diameter of the first circle upon which the holes are located will generally be less than or equal to the diameter of the circular radiating plate (302). Further, the length between the centers of any two adjacent holes can be equal so that the four holes form a square shape. Four screws can be used to mechanically couple the top plate/radiating aperture assembly to the four conductive posts (306) via the four holes.

The exemplary low profile antenna (300) also includes a dielectric spacer (304) with a low dielectric constant. The dielectric spacer (304) includes a top surface and a bottom surface with each surface forming a rectangular shape. The dielectric spacer (304) can have four holes corresponding to the four holes on the top plate/radiating aperture assembly. The dielectric spacer (304) includes holes that extend vertically through the dielectric spacer (304). The holes in the dielectric spacer (304) can accommodate the conductive posts (306). In one exemplary aspect, each conductive post (306) can be fastened to each hole in the dielectric spacer (304) with an adhesive. The dielectric spacer (304) is located on top of the base plate/ground plane (308).

In the exemplary low profile antenna (300), the assembly of the conductive posts (306), the coaxial connector (310), the top plate/radiating aperture assembly, and the base plate/ground plane (308) is similar to the assembly described above for FIGS. 2A-2B.

In the exemplary low profile antenna (300), the base plate/ground plane (308) can generally be the structural foundation of the exemplary low profile antenna. For example, the base plate/ground plane (308) can also generally be the fundamental supporting structure for the antenna assembly and can provide the mechanical means of mounting the antenna to various vehicles or platforms. In an exemplary aspect, the base plate/ground plane (308) can be rectangular in shape with dimensions similar to the dielectric spacer (304). The base plate/ground plane (308) can include four holes corresponding to and coincident with the four holes on the top plate/radiating aperture assembly.

The coaxial connectors (310) are connected to a feed network similar to the one described above in the first embodiment.

FIGS. 4A-4D shows a third exemplary embodiment of a low profile antenna (400). The antenna (400) includes a top plate/radiating aperture assembly (402) that radiates the outgoing electromagnetic wave in transmission and also receives an incoming electromagnetic wave in a reception operation. The top plate/radiating aperture assembly includes a radiating plate that is formed of an electrical conductor material, such as metal. Below the top plate/radiating aperture assembly is a cavity (404) located in between the top plate/radiating aperture and the base plate/ground plane (408). The base plate/ground plane (408) is located below the top plate/radiating assembly. The antenna (400) includes conductive posts (406) that connect the top plate/radiating assembly to the antenna transceiver circuit to send out outgoing antenna signals and to direct received antenna signals to the antenna transceiver circuit. Furthermore, the antenna (400) includes coaxial connectors (410)

that are mounted on the base plate/ground plane (408). The antenna (400) also includes a quadrature feed network as part of the antenna transceiver circuit. The quadrature fed network is electrically connected to the coaxial connectors. In an exemplary embodiment, the outer surface of the antenna (400) may be covered by a dielectric cover that can protect the antenna while permitting it to radiate. In some embodiments, the antenna (400) can also include side walls that can be slanted. In some embodiments, the antenna (400) can include side walls that can be vertical.

In the third exemplary embodiment, the top plate/radiating aperture assembly (402) includes a radiating plate. The radiating plate can be circular with a diameter that allows the low profile antenna to transmit and receive data in a frequency range of 300 MHz to 3 GHz. In some exemplary aspects, the radiating plate can have a diameter of 18.3 inches or 20 inches. In another exemplary aspect, the outer surface of the top plate/radiating aperture assembly (402) can be flat, singly curved, doubly curved or otherwise shaped as required. A flat top plate is relatively inexpensive and can be suitable for many applications. A singly or doubly curved top plate can be advantageous either for modifying the shape of radiation patterns or to conform the outer surface of the antenna to the outer mold line of the vehicle or platform onto or into which the antenna is integrated. The top plate/radiating aperture assembly (402) can have four holes located on the perimeter of a first circle with an angular spacing of 90° between the four angles formed by the location of the four holes. The diameter of the first circle upon which the holes are located will generally be less than or equal to the diameter of the circular radiating plate. Further, the length between the centers of any two adjacent holes can be equal so that the four holes form a square shape. Four screws can be used to mechanically couple the top plate/radiating aperture assembly (402) to the four conductive posts (406) via the four holes.

The antenna (400) also includes a cavity (404) that can be a square shape, diamond shaped, circular shaped, or any other shape as suited to particular application. Some applications may require that the antenna not protrude above the surrounding surface. An example would be an aircraft antenna where a protruding antenna would incur an aerodynamic drag. In such exemplary cases the antenna can be recessed into a cavity such that the resulting assembly can be flush with the surrounding surface used to mount the antenna. The shape of the cavity can be chosen for convenience or to satisfy any other requirement.

In the exemplary low profile antenna (400), the assembly of the conductive posts (406), the coaxial connector (410), the top plate/radiating aperture assembly (402), and base plate/ground plane (408) is similar to the assembly described above for FIGS. 2A-2B.

Figure 4A:
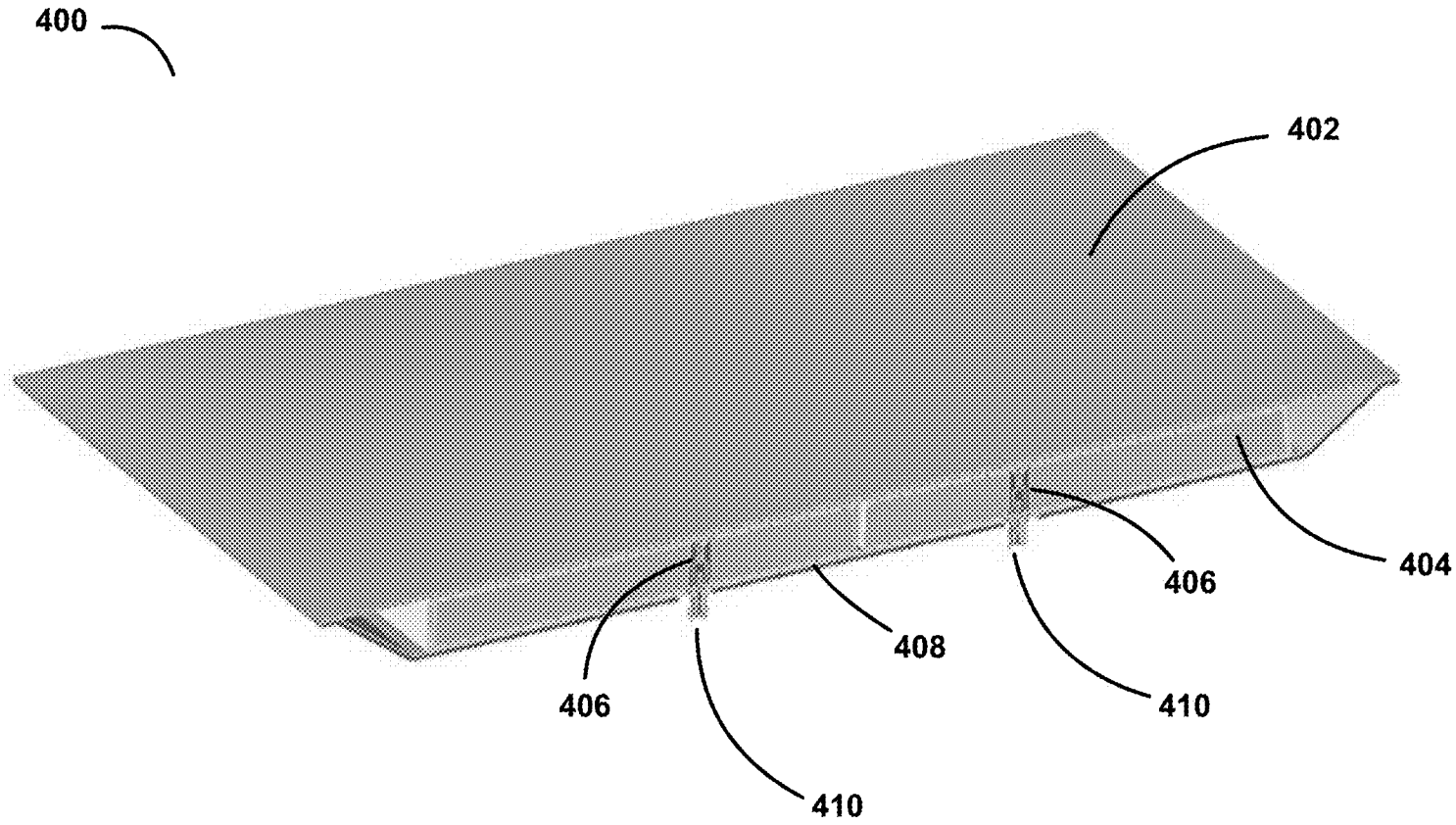
FIG. 4A shows an isometric cross section view of a third exemplary low profile SATCOM/MUOS antenna.
Figure 4B:
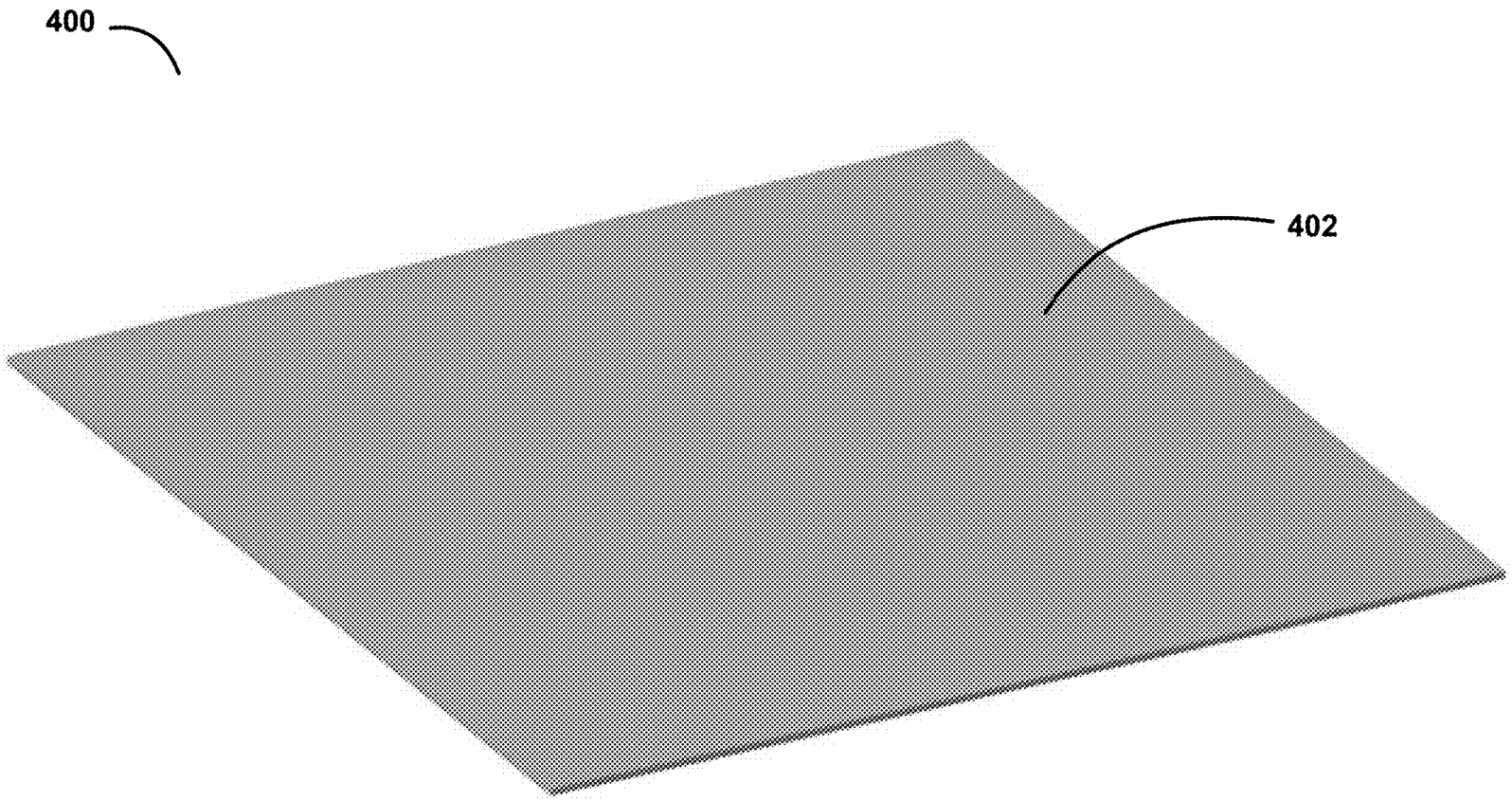
FIG. 4B shows a top view of the third exemplary low profile SATCOM/MUOS antenna.
Figure 4C:
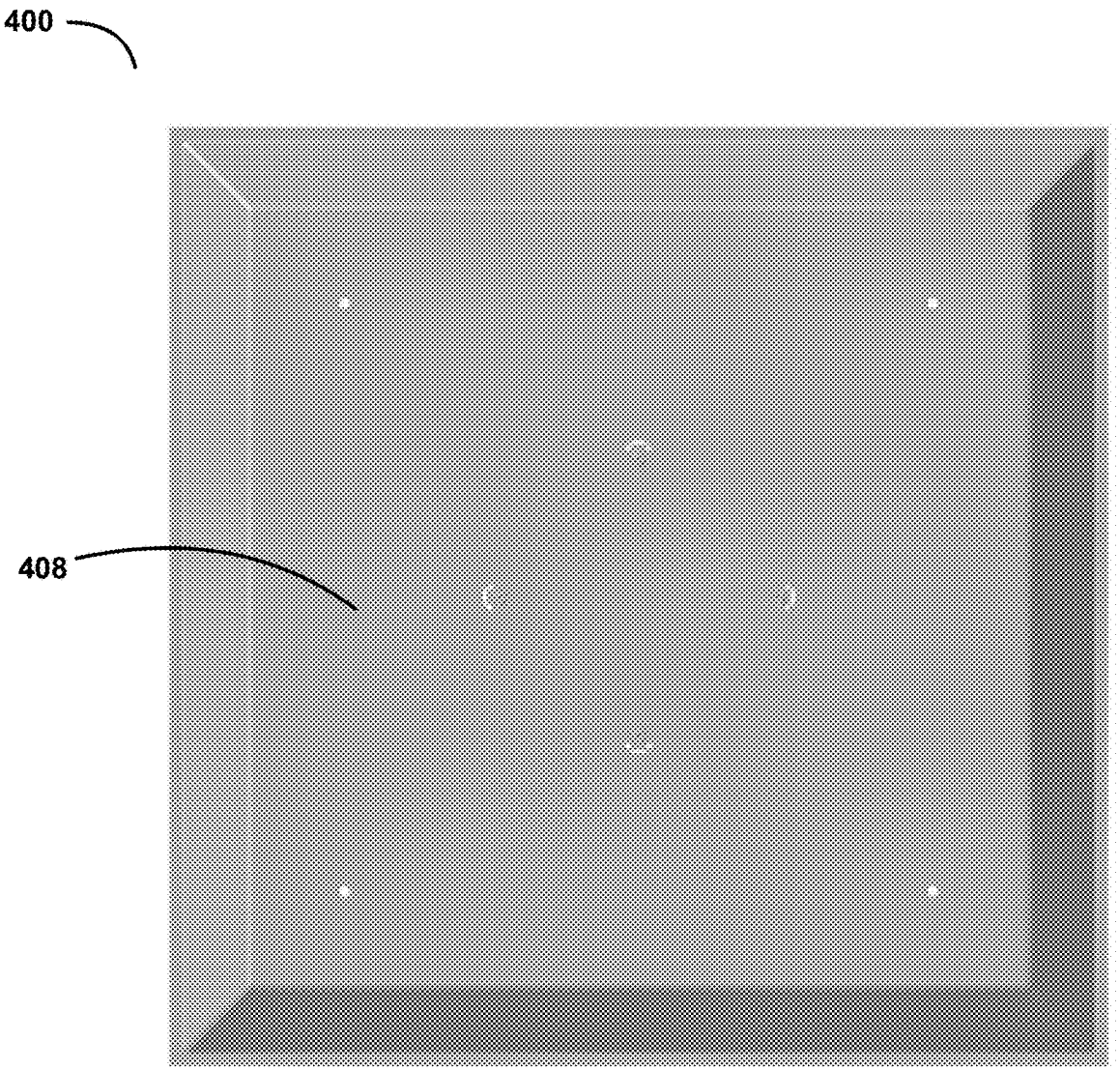
FIG. 4C shows a bottom view of the third exemplary low profile SATCOM/MUOS antenna.
Figure 4D:
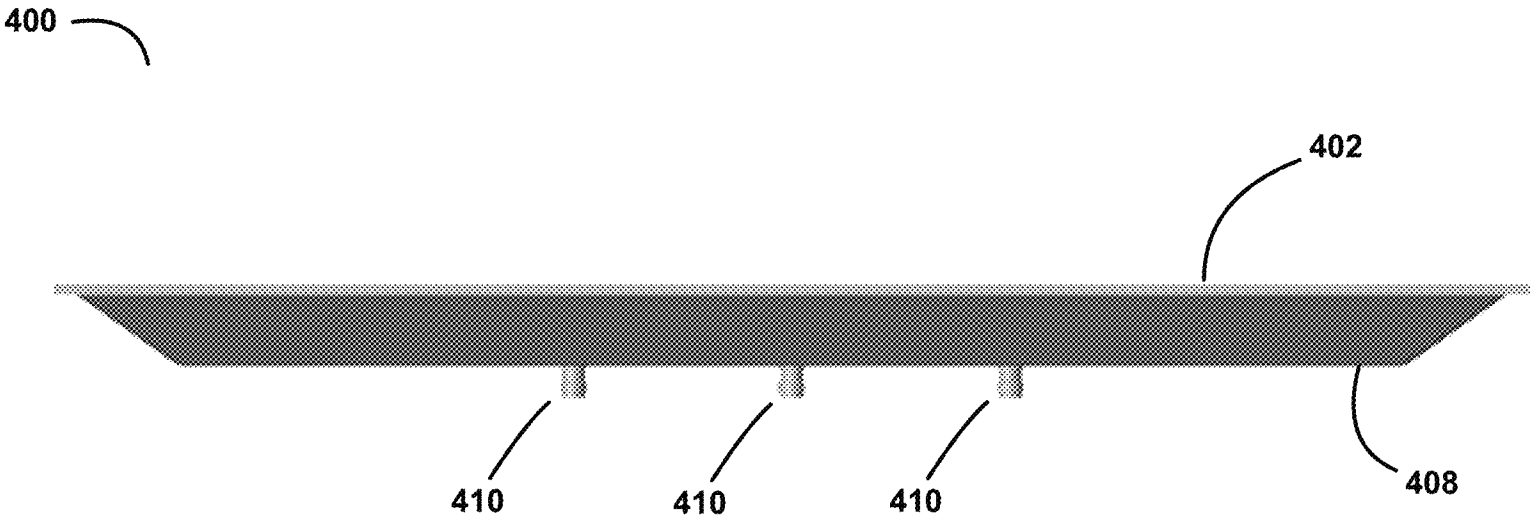
FIG. 4D shows a side view of the third exemplary low profile SATCOM/MUOS antenna.

As described below, the outer surface of the low profile antenna (400) is designed to conform to the outer mold line of a vehicle carrying the antenna. As shown in FIGS. 4C-4D, the base plate/ground plane (408) can generally be the structural foundation of the exemplary low profile antenna. For example, the base plate/ground plane (408) can also generally be the fundamental supporting structure for the antenna assembly and can provide the mechanical means of mounting the antenna to various vehicles or platforms. FIG. 4C-4D is a bottom view and a side view of a base plate/ground plane (408) that includes an outer surface that can be flush with the surrounding structure. The base plate/ground plane (408) can be a thin metal shell that can be stamped from sheet metal or machined from a metal billet. In an exemplary aspect, as shown in FIG. 4D, a side profile of the low profile antenna (400) shows a side surface forming a trapezoid shape.

The coaxial connectors (410) are connected to a feed network similar to the one described above in the first embodiment.

In this patent document, the word "exemplary" is used to mean serving as an example, instance, or illustration. Any embodiment or design described herein as "exemplary" is not necessarily to be construed as preferred or advantageous over other embodiments or systems. Rather, use of the word exemplary is intended to present concepts in a concrete manner.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. An antenna, comprising:

a top metal circular plate to radiate or receive electromagnetic waves;

a dielectric spacer formed of a first dielectric material and located below the top metal circular plate, the dielectric spacer comprising openings extending vertically through the dielectric spacer;

a base plate located below the dielectric spacer, the base plate including multiple coaxial connectors;

a plurality of conductive posts, wherein each conductive post is located in each opening in the dielectric spacer, and each conductive post comprises a top portion and a bottom portion, wherein the top portion of each conductive post is in contact with the top metal circular plate, and the bottom portion of each conductive post is electrically coupled to a center conductor of a corresponding coaxial connector;

a feed network connected to each coaxial connector, wherein the feed network is configured to produce a circularly polarized radiated field;

a plurality of radially distributed indentations located on a bottom surface of the dielectric spacer; and a plurality of blocks located below the dielectric spacer, wherein each block is located in each indentation of the dielectric spacer and is formed of a second dielectric material having a dielectric constant higher than a dielectric constant of the first dielectric material.

2. The antenna of claim 1, wherein the top metal circular plate includes holes located along a perimeter of a first circle, wherein each hole allows the top portion of each conductive post to be in contact with the top metal circular plate; and the base plate comprises orifices located along a perimeter of a second circle, wherein each orifice includes a coaxial connector.

3. The antenna of claim 2, wherein a first diameter of the first circle including the holes is the same as a second diameter of the second circle including the orifices, wherein each hole in the top metal circular plate is coincident with a corresponding orifice in the base plate.

4. The antenna of claim 2, wherein the top metal circular plate includes four holes located along the perimeter of the first circle with an angular spacing of 90° between each of four angles formed by the location of the four holes.

5. The antenna of claim 4, wherein the location of the four holes forms a square shape.

6. The antenna of claim 2, wherein the base plate includes four orifices.

7. The antenna of claim 1, wherein the conductive posts include four conductive posts.

8. The antenna of claim 1, wherein the top portion of each conductive post includes a first indentation to receive a screw to secure the top metal circular plate to the top portion of the conductive post.

9. The antenna of claim 1, wherein the bottom portion of each conductive post includes a second indentation to receive the center conductor of the coaxial connector.

10. The antenna of claim 1, wherein the dielectric spacer is circular.

11. The antenna of claim 10, wherein the dielectric spacer has a diameter that is equal to a diameter of the top metal circular plate.

12. The antenna of claim 1, wherein each of the indentations and each of the blocks has a trapezoid shape.

13. The antenna of claim 12, wherein each of the trapezoid shaped indentations includes a curved base located along an outer circumference of the dielectric spacer.

14. The antenna of claim 1, further comprising a metal post located on top of the base plate with a center of the metal post coinciding with a center of the top metal circular plate.

15. The antenna of claim 1, wherein the coaxial connector is mechanically coupled to a bottom side of the base plate using at least one of soldering, threaded fittings, or set screw.

16. The antenna of claim 1, wherein locations of the coaxial connectors form a quadrilateral with an axis of symmetry that is rotated 90 degrees relative to an axis of symmetry of the base plate.

* * * * *